US005328565A

United States Patent [19]

Rasch et al.

[11] Patent Number: 5,328,565

[45] Date of Patent: * Jul. 12, 1994

[54] TISSUE PAPER HAVING LARGE SCALE, AESTHETICALLY DISCERNIBLE PATTERNS

[75] Inventors: David M. Rasch; Thomas A. Hensler; Dean J. Daniels, all of Cincinnati, Ohio

[73] Assignee: The Procter & Gamble Company, Cincinnati, Ohio

[ * ] Notice: The portion of the term of this patent subsequent to Jan. 11, 2011 has been disclaimed.

[21] Appl. No.: 33,713

[22] Filed: Mar. 18, 1993

Related U.S. Application Data

[63] Continuation of Ser. No. 718,452, Jun. 19, 1991, abandoned.

[51] Int. Cl.[5] ..... D21H 15/02

[52] U.S. Cl. ..... 162/113; 162/111; 162/109; 162/116

[58] Field of Search ..... 162/109, 111, 113, 116, 162/205; 428/153

[56] References Cited

U.S. PATENT DOCUMENTS

| | | | |
|---|---|---|---|
| 3,034,180 | 5/1962 | Greiner et al. | 19/155 |
| 3,322,617 | 5/1967 | Osborne | 162/296 |
| 3,432,936 | 3/1969 | Cole et al. | 34/6 |
| 3,549,742 | 12/1970 | Benz | 264/250 |
| 3,556,907 | 1/1971 | Nystrand | 156/470 |
| 3,681,183 | 8/1972 | Kalwaites | 161/109 |
| 4,376,671 | 3/1983 | Schulz | 156/549 |
| 4,529,480 | 7/1985 | Trokhan | 162/109 |
| 4,637,859 | 1/1987 | Trokhan | 162/109 |
| 4,659,608 | 4/1987 | Schulz | 428/171 |
| 4,759,391 | 7/1988 | Waldvogel et al. | 139/383 A |
| 4,798,760 | 1/1989 | Diaz-Kotti | 428/234 |
| 4,921,034 | 5/1990 | Burgess et al. | 162/117 |
| 4,968,386 | 11/1990 | Nguyen | 162/262 |
| 5,126,015 | 6/1992 | Pounder | 162/206 |

FOREIGN PATENT DOCUMENTS

| | | | |
|---|---|---|---|
| 2132141A | 7/1984 | United Kingdom | B44C 1/24 |

OTHER PUBLICATIONS

Experimental Use: P&G Test Nos.: 0786–67; 0786–68; 1636–24; and 1638–24.

*Primary Examiner*—W. Gary Jones
*Assistant Examiner*—Dean T. Nguyen
*Attorney, Agent, or Firm*—Larry L. Huston; Gerry S. Gressel; E. Kelly Linman

[57] ABSTRACT

The present invention is directed to a single lamina tissue paper having visually discernible, large scale patterns made during the drying step of the papermaking process. Particularly, the tissue is made on a blow through drying belt having a pattern of alternating knuckles and deflection conduits. This pattern produces a like pattern of regions in the paper having alternating values of crepe frequencies, opacities and elevations. The differences in these values produces a visually discernible pattern.

9 Claims, 4 Drawing Sheets

TISSUE PAPER HAVING LARGE SCALE, AESTHETICALLY DISCERNIBLE PATTERNS

This is a continuation of application Ser. No. 07/718/452, filed on Jun. 19, 1991, now abandoned.

FIELD OF THE INVENTION

The present invention relates to a cellulosic fibrous structure, particularly tissue paper, having a pattern visually distinguishable from the apparent background of the cellulosic fibrous structure. The pattern imparts an aesthetically desirable appearance to the cellulosic fibrous structure. Also, the apparatus for making such a cellulosic fibrous structure forms part of the present invention.

BACKGROUND OF THE INVENTION

Cellulosic fibrous structures, such as tissue products, are in almost constant use in daily life. Toilet tissue, paper towels and facial tissue are examples of cellulosic fibrous structures used throughout home and industry.

Many attempts have been made to provide tissue products which are more consumer preferred than the tissue products offered by the competition. One approach to providing consumer preferred tissue products has been to provide a cellulosic fibrous structure having improved bulk and flexibility, as illustrated in U.S. Pat. No. 3,994,771 issued Nov. 30, 1976 to Morgan et al. Improved bulk and flexibility, may also be provided through bilaterally staggered compressed and uncompressed zones, as illustrated in U.S. Pat. No. 4,191,609, issued Mar. 4, 1980 to Trokhan.

Another approach to making tissue products more consumer preferred is to increase the softness of such products. Softness may be enhanced by providing desired surface characteristics, as illustrated in U.S. Pat. No. 4,300,981, issued Nov. 17, 1981 to Carstens. Another approach to increasing the softness of a cellulosic fibrous structure is to provide an emollient on the cellulosic fibrous structure substrate, as illustrated in U.S. Pat. No. 4,481,243, issued Nov. 6, 1984 to Allen and U.S. Pat. No. 4,513,051, issued Apr. 23, 1985 to Lavash.

Another approach to making tissue products more consumer preferred is to advantageously dry the cellulosic fibrous structure to impart greater tensile strength and burst strength to the tissue products. Examples of cellulosic fibrous structure made in this manner are illustrated in U.S. Pat. No. 4,637,859, issued Jan. 20, 1987 to Trokhan. Alternatively, the cellulosic fibrous structure may be made stronger, without utilizing more cellulosic fibers and hence making the tissue product more expensive, by having regions of differing basis weights as illustrated in U.S. Pat. No. 4,514,345, issued Apr. 30, 1985 to Johnson et al.

Within the constraints imposed by the foregoing ways to make cellulosic tissue products more appealing to the consumer, manufacturers have attempted yet another manner to make the cellulosic tissue products have more appeal to the consumer—improving the aesthetic presentation of such products. A number of approaches have been attempted to improve the aesthetic appearance of the tissue product to the consumer.

For example, embossed patterns in cellulosic fibrous structures are very common. In fact, considerable efforts in the prior art have been directed to embossing cellulosic fibrous structures. One well-known embossed pattern, which appears in cellulosic paper towel products marketed by The Procter & Gamble Company and assignee of the present invention, is illustrated in U.S. Patent Des. 239,137 issued Mar. 9, 1976 to Appleman.

Typically, embossing is either performed by an apparatus directed to one of two well known processes, nested embossing or knob to knob embossing. Nested embossing is illustrated in U.S. Pat. No. 3,556,907 issued Jan. 19, 1971 to Nystrand and in U.S. Pat. No. 3,867,225 issued Feb. 18, 1975 to Nystrand. In the nested embossing process, as illustrated by the Nystrand teachings, protrusions and depressions in the embossing rolls are registered and axially synchronously rotated, producing a like pattern of protrusions and depressions in the cellulosic fibrous structures produced thereby.

Knob to knob embossing registers the protrusions of the embossing rolls, as illustrated in U.S. Pat. No. 3,414,459 issued Dec. 3, 1968 to Wells. Knob to knob embossing produces a cellulosic fibrous structure having discrete sites in each of the two plies bonded together.

Variations in these embossing processes have also been attempted. For example, having embossments on a cellulosic fibrous structure with a major axis substantially aligned in the cross machine direction, is illustrated in UK Patent Application GB 2,132,141A published Jul. 4, 1984 in the name of Bauernfeind.

However, any of the embossing processes known in the prior art imparts a particular aesthetic appearance to the cellulosic fibrous structure at the expense of other properties of the cellulosic fibrous structure desired by the consumer. This expense results in a trade-off between aesthetics and certain other desired properties and aesthetics.

More particularly, embossing disrupts bonds between fibers in the cellulosic fibrous structure. This disruption occurs because the bonds are formed and set upon drying of the embryonic fibrous slurry. After drying, moving selected fibers normal to the plane of the cellulosic fibrous structure breaks the bonds. Breaking the bonds results in a cellulosic fibrous structure having less tensile strength and possibly less softness than existed before embossing. Unfortunately, this trade-off is not consumer preferred because, as discussed above, softness and tensile strength are consumer preferred properties. Thus, a functional, but plain appearing cellulosic fibrous structure can be transmogrified into a less functional, but visually more attractive, cellulosic fibrous structure through embossing.

Another method to impart visible and aesthetically distinguishable patterns to a cellulosic fibrous structure is by printing an ink pattern onto the cellulosic fibrous structure. The ink pattern contrasts in color with the background of the cellulosic fibrous structure, so that the pattern is aesthetically distinguishable from background of the cellulosic fibrous structure and is readily visually detected by the consumer. Ink printing a pattern onto a cellulosic fibrous substrate has the advantage that any variety of sizes, shapes and colors of patterns may be utilized.

However, printing ink patterns onto cellulosic fibrous structures has several drawbacks. The ink represents an additional material cost which must be accounted for in manufacture and is commonly passed on to the consumer. The ink must be qualified for epidermal contact and not present a biological hazard upon disposal. Ink has been known to spill during manufacture, presenting a health hazard to workers.

Furthermore, the machinery necessary to contain the ink is often complex and sophisticated, as illustrated in U.S. Pat. No. 4,581,995, issued Apr. 15, 1986 to Stone and U.S. Pat. No. 4,945,832, issued Aug. 7, 1990 to Odom. Such complex machinery represents a capital investment and must be frequently cleaned and maintained. Cleaning and maintenance leads to downtime and expense in producing the tissue product having an ink printed cellulosic fibrous structure substrate.

Yet another manner in which a visually discernible pattern may be imparted to a cellulosic fibrous structure is by utilizing the forming section of the papermaking machine used to manufacture the cellulosic fibrous structure. For example, the aforementioned Trokhan and Johnson et al. patents disclose cellulosic fibrous structures having varying basis weights in different regions of the cellulosic fibrous structures.

In particular, Johnson et al. discloses a cellulosic fibrous structure having a continuous high basis weight network with discrete low basis weight regions dispersed therein. Conversely, Trokhan discloses a cellulosic fibrous structure having a continuous low basis weight network with discrete high basis weight regions dispersed therein.

The difference in opacity, which is incidental to a difference in basis weight or difference in density of such regions, will often cause a pattern to be visually discernible to the consumer. Thus, an visually discernible pattern can be formed in a cellulosic fibrous structure by adjusting the basis weight of different regions of the cellulosic fibrous structure.

However, such patterns may neither be aesthetically pleasing nor relatively large in scale. Furthermore, the aesthetic discernibility of such patterns may be limited by foreshortening of the cellulosic fibrous structure which occurs during creping.

During creping, it is typical for a doctor blade to scrape the cellulosic fibrous structure from a Yankee drying drum and cause foreshortening of the cellulosic fibrous structure to occur. This foreshortening results in flutter or rugosities normal to the plane of the tissue. The amplitude and frequency of the flutter will differ in various regions of the cellulosic fibrous structure, in a manner visually discernible to the consumer.

If a region of the cellulosic fibrous structure is too large, rather than foreshorten to an aesthetically pleasing pattern, the region may buckle and hang, presenting a limp, low quality appearance to the consumer. This undesirable appearance frequently occurs when trying to make relatively large scale patterns visually discernible in the cellulosic fibrous structure by using the forming section of a papermaking machine.

Also, elevational differences in various regions of the cellulosic fibrous structure are often aesthetically discernible to the consumer. For example, if one region of the cellulosic fibrous structure is raised or lowered within the plane of the cellulosic fibrous structure relative to another region of the cellulosic fibrous structure, highlights and shadows may appear. The highlights and shadows cause different regions of the cellulosic fibrous structure to appear lighter or darker even though the cellulosic fibrous structure is monochromatic. Furthermore, if the elevational differences are significant the regions will be visually discernible to the consumer due to his or her depth perception.

Accordingly, it is an object of this invention to impart visually discernible patterns to a cellulosic fibrous structure, and in particular, relatively large scale visually discernible patterns to a cellulosic fibrous structure. It it also an object of this invention to provide an apparatus for making such a cellulosic fibrous structure.

BRIEF SUMMARY OF THE INVENTION

The invention comprises a single lamina cellulosic fibrous structure having at least three visually discernible regions. The three regions are mutually visually distinguishable by an optically intensive property such as crepe frequency, elevation or opacity.

The fibrous structure comprises a background matrix having a first value of a particular optically intensive property. Disposed within the background matrix is a first annular region having a second value of the optically intensive property. Disposed substantially within the first annular region is a second annular region having a third value of the optically intensive property. The third value of the optically intensive property of the second region is different than the second value of the optically intensive property of the first annular region. Disposed within the second annular region is a third region having a value of the optically intensive property substantially different than the third value of the optically intensive property of the second annular region.

The value of the optically intensive property of the third region may equal the value of the optically intensive property of the first annular region. Alternatively, the value of the optically intensive property of the third region may be different than the value of the optically intensive property of both the first and second annular regions. However, the optically intensive properties of adjacent regions must be mutually different.

If desired, the third region may be annular and have a fourth region disposed therein with yet another value of the optically intensive property. The value of the optically intensive property of the fourth region may be generally equivalent the first value of the optically intensive property of the background matrix, the third value of the optically intensive property of the second annular region, or yet a different value of the optically intensive property.

The cellulosic fibrous structure according to the present invention may be manufactured using a continuous belt for drying the cellulosic fibrous structure. The continuous belt has a woven foraminous element and superimposed thereon a means for imparting a pattern of at least three visually discernible regions to the cellulosic fibrous structure.

The belt may comprise an annular first flow element having a first flow resistance. The first flow element at least partially circumscribes an annular second flow element having a second flow resistance generally different than the first flow resistance. The second flow element at least partially circumscribes a third flow element having a flow resistance generally different than the flow resistance of the second flow element.

If desired, the third flow element may be annular and circumscribe yet a fourth flow element having a flow resistance generally different than the flow resistance of the third flow element.

BRIEF DESCRIPTION OF THE DRAWINGS

While the Specification concludes with claims particularly pointing out and distinctly claiming the present invention, it is believed the invention is better understood from the following description taken in conjunction with the associated drawings, in which like elements are designated by the same reference numeral and:

DETAILED DESCRIPTION OF THE INVENTION

Figure 1:
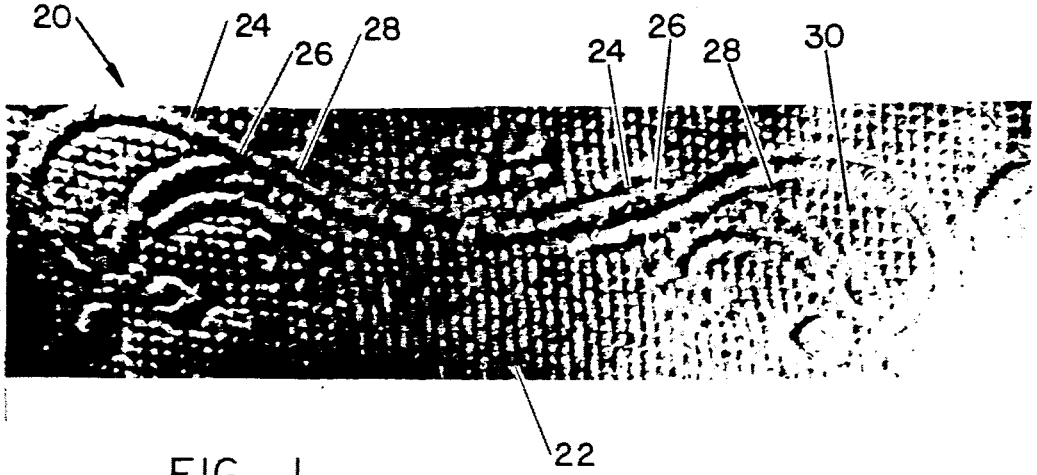
FIG. 1 is a photomicrograph of a cellulosic fibrous structure having visually discernible patterns according to the present invention, particularly a pattern having three aesthetically distinguishable regions and a pattern having four aesthetically distinguishable regions.
Figure 2:
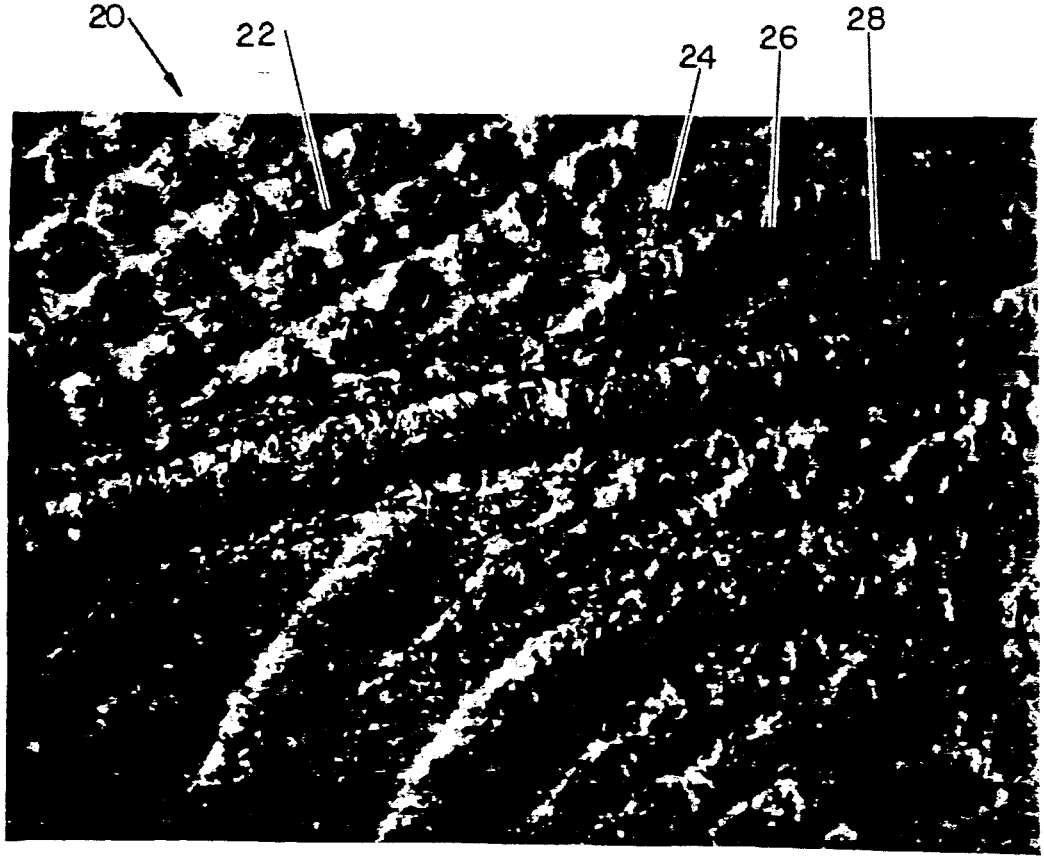
FIG. 2 is an enlarged view of FIG. 1, showing the three region pattern.

As illustrated in FIG. 1, a cellulosic fibrous structure 20 according to the present invention comprises a background matrix 22 onto which are superimposed at least three visually discernible different regions 24, 26 and 28 forming a particular pattern. If desired, the pattern may comprise four (or more) visually discernible regions 24, 26, 28 and 30, as illustrated in FIG. 2. Each of the regions 24, 26, 28 and 30 is mutually visually distinguishable from the other regions 24, 26, 28 and 30 and the background matrix 22.

While, of course, the visual discernibility of the pattern and the visual distinguishability of the regions 24, 26, 28 and 30 is dependent upon the acuity of the eyesight of the consumer, the different regions 24, 26, 28 and 30 of the cellulosic fibrous structure 20 can be distinguished from one another by the value of any one of three optically intensive properties. As used herein, "optically intensive properties" are three specified properties which do not change in value upon the aggregation of cellulosic fibers to the cellulosic fibrous structure 20 within the plane of the cellulosic fibrous structure 20 or upon aggregating a foreign substance, such as ink, with the cellulosic fibrous structure 20. The three specified properties are crepe frequency, elevation and opacity. Thus, patterns formed by contrasting colors are not considered to be formed by optically intensive properties.

Moreover and with continuing reference to FIG. 1, the different regions 24, 26 and 28 of the cellulosic fibrous structure 20 are disposed in patterns, as set forth below, which are large enough to be discerned by a consumer and distinguished from the background matrix 22 of the cellulosic fibrous structure 20. The relatively large size of the pattern enhances consumer understanding that the purpose of the pattern is to impart an aesthetically pleasing appearance to the cellulosic fibrous structure 20 and thereby make the tissue product more desirable to the consumer.

One value of an optically intensive property which may be used to distinguish one region 24, 26 or 28 of the cellulosic fibrous structure 20 from another region 24, 26 or 28 of the cellulosic fibrous structure 20 is the value of the crepe frequency of that region 24, 26 or 28. The crepe frequency is defined as the number of times a peak occurs on the surface of the cellulosic fibrous structure 20 for a given linear distance. More particularly, "crepe frequency" is defined as the number of cycles per millimeter (cycles per inch) of the region 24, 26 or 28. These cycles are associated with chatter of the aforementioned doctor blade during the creping operation.

The crepe frequency is closely associated with the amplitude of the undulations which form the cycles. The crepe frequency is generally not the same as the frequency of the regions 24, 26 or 28 forming the pattern of the surface topography of the cellulosic fibrous structure 20.

It is to be recognized that the value of the crepe frequency may not be constant throughout a given region 24, 26 or 28. Therefore, it is important to measure a large enough distance or combination of distances throughout a particular region 24, 26 or 28 so that the value of a particular crepe frequency may be found.

Furthermore, if one examines the background matrix 22 of the cellulosic fibrous structure 20, at least two values of crepe frequencies may be present. This may occur, for example, if the background matrix 22 of the cellulosic fibrous structure 20 is made on a conventional forming wire and dried on a belt having a particular background matrix 22 or, alternatively, is made on a forming wire having a particular background matrix 22 thereon.

If the background matrix 22 is comprised of more than one value of crepe frequency, as opposed to normal and expected variations within the same crepe frequency, the crepe frequency of the background matrix 22 is considered to be the lower or lowest frequency of the plurality of individual crepe frequencies present. Of course, it is expected the background matrix 22 of the cellulosic fibrous structure 20 will comprise the majority of the surface area of the cellulosic fibrous structure 20.

A value of a second optically intensive property which may be used to distinguished one region 24, 26 or 28 from another region 24, 26 or 28 is the opacity of that region 24, 26 or 28. "Opacity" is the property of a cellulosic fibrous structure 20 which prevents or reduces light transmission therethrough. Opacity is directly related to the basis weight and uniformity of fiber distribution of the cellulosic fibrous structure 20 and is also influenced by the density of the cellulosic fibrous structure 20. A cellulosic fibrous structure 20 having a relatively greater basis weight or uniformity of fiber distribution will also have a greater opacity for a given density.

As used herein, the "basis weight" of a region 24, 26 or 28 is the weight, measured in grams force, of a unit area of that region 24, 26 or 28 of the cellulosic fibrous structure 20, which unit area is taken in the plane of the cellulosic fibrous structure 20. The size and shape of the unit area from which the basis weight is measured is dependent upon the relative and absolute sizes and shapes of the regions 24, 26 and 28 forming the background matrix 22 and pattern of the cellulosic fibrous structure 20 under consideration. The "density" of a region 24, 26 or 28 is the basis weight of such a region 24, 26 or 28 divided by its thickness.

It will be recognized by one skilled in the art that within a given region 24, 26 or 28, ordinary and expected basis weight fluctuations and variations may occur, when a given region 24, 26 or 28 is considered to have a basis weight of one particular value. For example, if on a microscopic level, the basis weight of an interstice between cellulosic fibers is measured, an apparent basis weight of zero will result when, in fact, unless an aperture in the cellulosic fibrous structure 20 is being measured the basis weight of such region 24, 26 or 28 is greater than zero. Such fluctuations and variations are normal and expected part of the manufacturing process.

It is not necessary a perfect or razor sharp demarkation between adjacent regions 24, 26 and 28 of different basis weights be apparent. It is only important that the distribution of fibers per unit area be different in adjacent regions 24, 26 and 28 of the fibrous structure and that such different regions 24, 26 and 28 occur in a visually discernible pattern. The different basis weights of the regions 24, 26 and 28 provide for different opacities of such regions 24, 26 and 28.

Increasing the density of a region 24, 26 or 28 having a particular basis weight will increase the opacity of such region 24, 26 or 28 up to a point. Beyond this point, further densification of a region 24, 26 or 28 having a particular basis weight will decrease opacity. Thus, two regions 24, 26 and 28 of the same basis weights may have different opacities, depending upon the relative densification of such regions 24, 26 and 28. Alternatively, two regions 24, 26 and 28 of the same opacity may have different basis weights and not otherwise be visually distinguishable to the consumer.

The third optically intensive property value which may be utilized to distinguish one region 24, 26 or 28 from another region 24, 26 or 28 is the elevation of such regions 24, 26 and 28. As used herein the "elevation" is the distance, taken normal to the plane of the cellulosic fibrous structure 20, of a region 24, 26 or 28 as measured from the lowest repeating level of the background matrix 22 of the cellulosic fibrous structure 20 when it is viewed from the face not in contact with the drying belt 50. A region 24, 26 or 28 may vary in elevation from the place of the background matrix 22 in either direction normal to the plane of the cellulosic fibrous structure 20. The elevational differences create shadows and highlights in adjacent regions 24, 26 and 28, causing the pattern to be visually discernible.

For two regions 24, 26 or 28 of the cellulosic fibrous structure 20 to be mutually visually distinguishable based on elevation differences (and the pattern to be visually discernible), it is preferred that the value of elevations between adjacent regions 24, 26 and 28 varies by at least about 0.05 millimeters (0.002 inches), more preferably about 0.08 millimeters (0.003 inches) to about 0.23 millimeters (0.009 inches), but not more than about 0.38 millimeters (0.015 inches).

Figure 3:
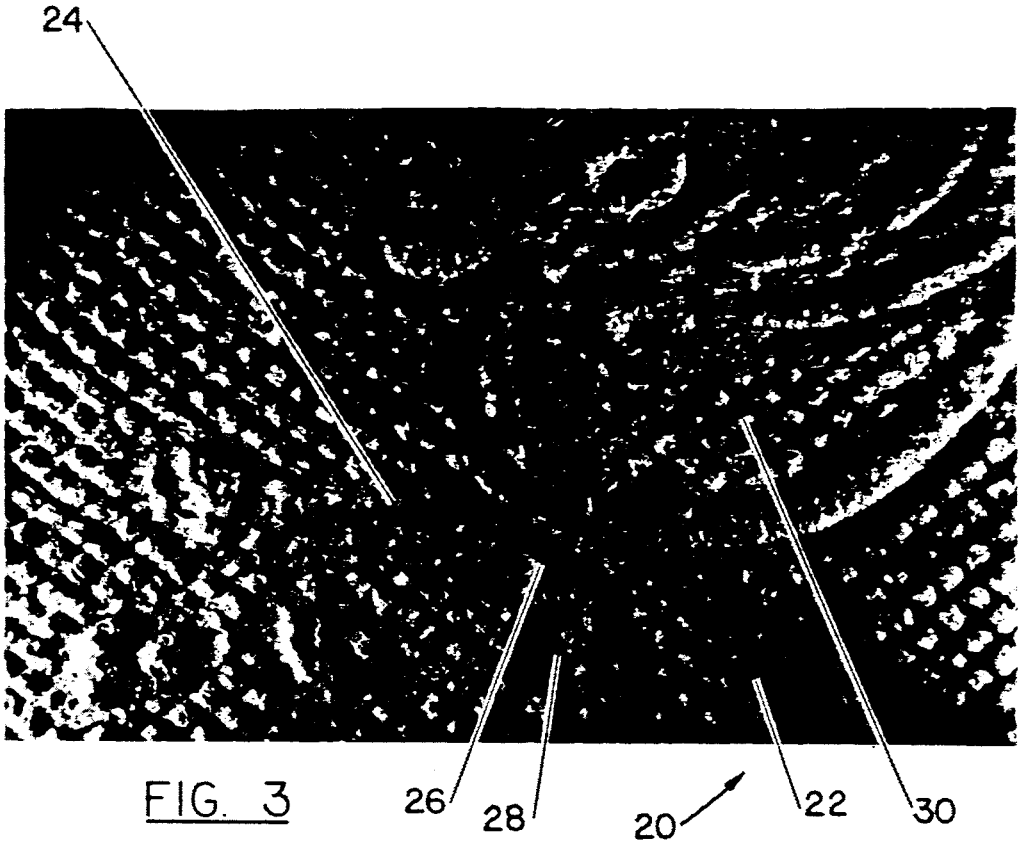
FIG. 3 is an enlarged view of FIG. 1, showing the four region pattern.

If mutual distinguishability and visual discernibility are based on differences in crepe frequency, the crepe frequency of adjacent regions 24, 26 and 28 should vary by at least about 2 cycles per millimeter (51 cycles per inch) and preferably at least about 5 cycles per millimeter (130 cycles per inch). The frequency of the micropattern of the background matrix 22 shown in FIGS. 1–3 is about 0.87 cycles per millimeter (20.0 cycles per inch). The crepe frequency of the first and third annular regions 24 and 28 is about 7 to about 8 cycles per millimeter (180 to 200 cycles per inch). The crepe frequency of the second annular region 26 is about 2 cycles per millimeter (50 cycles per inch).

If mutual distinguishability and visual discernibility are based on differences in opacity, the opacity of adjacent regions 24, 26 and 28 should vary by at least about twenty grey levels. Thus, two adjacent regions 24, 26 or 28 may be visually discernible if the values of one, two or three of the optically intensive properties of such regions 24, 26 and 28 are different.

Of the three aforementioned optically intensive properties, the value of the elevation is judged the most critical in producing a visually discernible pattern. Thus, the elevation difference may be used alone, or in conjunction with either of the other two optically intensive properties to produce the desired pattern. Of course, the value of the elevation difference should increase if this property is not used in conjunction with opacity and crepe frequency to produce the desired pattern.

THE PRODUCT

A cellulosic fibrous structure 20 according to the present invention, as illustrated in FIG. 1, is composed of cellulosic fibers approximated by linear elements. The fibers are the components of the cellulosic fibrous structure 20 having one relatively large dimension (along the longitudinal axis of the fiber) compared to the other two relatively small dimensions (mutually perpendicular and being both radial and perpendicular to the longitudinal axis of the fiber), so that linearity is approximated.

The fibers comprising the cellulosic fibrous structure 20 may be synthetic, such as polyolefin or polyester; are preferably cellulosic, such as cotton linters, rayon or bagasse; and more preferably are wood pulp, such as soft woods (gymnosperms or coniferous) or hard woods (angiosperms or deciduous). As used herein, a fibrous structure 20 is considered "cellulosic" if the fibrous structure 20 comprises at least about 50 weight percent or at least about 50 volume percent cellulosic fibers, including but not limited to those fibers listed above.

A cellulosic mixture of wood pulp fibers comprising softwood fibers having a length of about 2.0 to about 4.5 millimeters and a diameter of about 25 to about 50 micrometers, and hardwood fibers having a length of less than about 1 millimeter and a diameter of about 12 to about 25 micrometers has been found to work well for the cellulosic fibrous structures 20 described herein.

The cellulosic fibrous structure 20 according to the present invention comprises a single lamina. However, it is to be recognized that two single laminae, either or both made according to the present invention, may be joined in face-to-face relation to form a unitary laminate and still fall within the scope of the present invention. A cellulosic fibrous structure 20 according to the present invention is considered to be a "single lamina" if it is taken off the forming element, discussed below, as a single sheet having a thickness prior to drying which does not change unless fibers are added to or removed from the sheet. The cellulosic fibrous structure 20 may be later embossed, or remain nonembossed, as desired.

The cellulosic fibrous structure 20 according to the present invention comprises a background matrix 22 which is the field of the cellulosic fibrous structure 20 presenting a relatively uniform and macroscopically uninterrupted appearance to the consumer. The background matrix 22 is the easil upon which visually discernible patterns may be established to provide an visually discernible appearance to the consumer. The background matrix 22 of the cellulosic fibrous structure 20 has a particular first set of optically intensive properties as described above.

Different regions 24, 26 and 28 may be established within the background matrix 22, which regions 24, 26 and 28 are distinguishable from the background matrix 22 and from each other by the values of the optically intensive properties in the different regions 24, 26 and 28. Visual discernibility and mutual distinction of regions 24, 26 and 28 occur if the value of an optically intensive property of one region 24, 26 or 28 is different than the value of the optically intensive property of an adjacent region 24, 26 or 28. It will be understood by one skilled in the art that the adjacent region 24, 26 or 28 may either be the background matrix 22, if the region 24, 26 or 28 under consideration is on the exterior of the pattern or, alternatively, the adjacent region 24, 26 or 28 may be another region 24, 26 or 28 of the pattern if such region 24, 26 or 28 is internal to an outer region 24 of the pattern.

Referring to FIG. 2, the regions 24, 26 and 28 of the cellulosic fibrous structure 20 according to the present invention are arranged in a particular pattern, so that a relatively large sized pattern may be formed and be more visually discernible to the consumer. Particularly, a pattern according to the present invention comprises a first region 24 having an annular shape.

The first region 24 has an value of the optically intensive property, as defined above, of a second value. The first value of the optically intensive property of the background matrix 22 and the second value of the first region 24 are mutually different, so that the background matrix 22 and first region 24 are mutually visually distinguishable. The first region 24 circumscribes an adjacent second region 26.

The second region 26 is also annular in shape and has a third value of the optically intensive property, This third value of the optically intensive property is different than the second value of the optically intensive property of the first region 24. The second visually discernible region 26 circumscribes a third region 28.

The third region 28 may be annular (as illustrated in FIG. 2) or solid as desired and has a fourth value of the optically intensive property. The fourth value of the optically intensive property of the third region 28 is different than the third value of the optically intensive property of the adjacent second region 26.

If desired, the fourth value of the optically intensive property of the third region 28 may be equivalent the first value of the optically intensive property of the background matrix 22 (or equivalent the second value of the optically intensive property of the first region 24). This is because the third region 28 and the background matrix 22 are separated by the first and second regions 24 and 26.

As used herein, an annular region 24, 26 or 28 is considered to "circumscribe" another region 24, 26 or 28 if the other region 26 or 28 is disposed substantially within the annular region 24, 26 or 28. Thus, it is not necessary that an annular region 24, 26 or 28 be closed or wholly contain another region 26 or 28 to consider the other region 26 or 28 to be circumscribed by the annular region 24, 26 or 28 or to consider the other region 26 or 28 to be substantially within the annular region 24, 26 or 28. This consideration is nothing more than to recognize imperfections in the patterns described and claimed hereunder may occur without detracting from the practice and scope of the claimed invention.

It is desirable that the regions 24, 26 and 28 of the cellulosic fibrous structure 20 be generally concentric. Concentricity requires the regions 24, 26 and 28 to have a common center, without regard to the shape of the region 24, 26 or 28. Even irregularly shaped regions 24, 26 and 28 are considered concentric if such regions 24, 26 and 28 have a common center. Concentricity of the regions 24, 26 and 28 draws the eye to a readily visually discernible pattern and amplifies its appearance to the observer.

It is further desirable that the regions 24, 26 and 28 of the cellulosic fibrous structure 20 be generally congruent. Congruency requires the regions 24, 26 and 28 have a common shape, but be of different sizes. Generally, congruent regions 24, 26 and 28 appear to have a common visual theme, and are more likely to be aesthetically pleasing to the consumer than regions 24, 26 and 28 which bear little similarity in shape to the adjacent region 24, 26 or 28. Of course it will be recognized that the first region 24 will not be concentric or congruent the background matrix 22, unless the first region 24 is concentric or congruent the borders of the tissue product of which the cellulosic fibrous structure 20 is made.

The regions 24, 26 and 28 of the patterns described hereunder may be either mutually concentric but not congruent, may be mutually congruent but not concentric or may be neither mutually concentric nor congruent. Of course, it will be understood that two of the three regions 24, 26 and 28 may be mutually concentric or may be mutually congruent but not the third as desired.

To increase the visual discernibility of the pattern, each annular region 24, 26 or 28 formed by a knuckle in the drying belt 50 should have a radial dimension of at least about 0.08 millimeters (0.003 inches) and preferably of at least about 0.64–1.27 millimeters (0.025–0.050 inches) but not greater than about 2.0 millimeters (0.08 inches), for processability. Each annular region 24, 26 or 28 formed by a deflection conduit in the drying belt 50 should have a radial dimension of at least about 0.13 millimeters (0.005 inches) and preferably about 0.76 to about 3.18 millimeters (0.030 to 0.125 inches), but not greater than about 12.7 millimeters (0.500 inches), for processability. In no case should the radial dimension of any region 24, 26 or 28 be less than the width of the regions forming the background matrix 22. Furthermore, the first region 24 should have a diametrical dimension in any direction of at least about 12.7 millimeters (0.5 inches).

As illustrated in FIG. 3 if desired, the third region 28 may also be annular and circumscribe a fourth region 30 having an optically intensive property not equal in value to the value of the optically intensive property of the third region 28. The value of the optically intensive property of the fourth region 30 may be substantially equivalent the value of the optically intensive property of the background matrix 22 or may be wholly different than the values of the optically intensive properties of the first three regions 24, 26 and 28. It is only important that the value of the optically intensive property of the fourth region 30 be substantially different than the value of the optically intensive property of the adjacent third region 28, so that aesthetic discernibility is maintained and the third and fourth regions 28 and 30 are mutually aesthetically distinguishable.

Of course it will be apparent to one skilled in the art that cellulosic fibrous structures (not shown) having patterns comprising five or more annular regions circumscribing adjacent inner regions having a different value of the optically intensive property are feasible. This is nothing more than to recognize several combinations and permutations of the claimed invention can be produced by one skilled in the art.

THE APPARATUS

A cellulosic fibrous structure 20 according to the present invention may be manufactured utilizing a papermaking machine having a blow through drying process. Such a process is fully described in U.S. Pat. No. 4,529,480 issued Jul. 16, 1985 to Trokhan, which patent is incorporated herein by reference for the purpose of showing a suitable method of manufacturing the present invention.

However, the drying belt 50 of the apparatus illustrated in the aforementioned Trokhan patent application must be modified from the prior art as described below to produce a cellulosic fibrous structure 20 according to the present invention. The drying belt 50 comprises two different types of flow elements, knuckles and deflection conduits. The knuckles and deflection conduits are superimposed onto a woven reinforcing structure.

Figure 4:
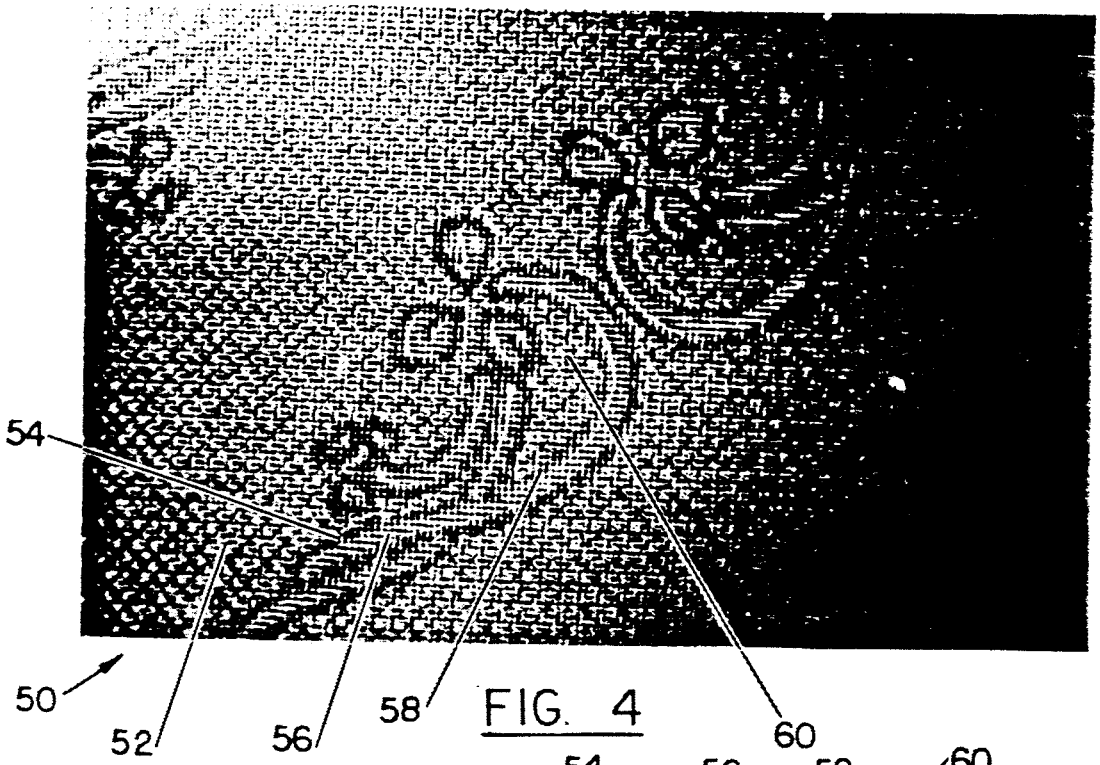
FIG. 4 is a fragmentary top plan view of a drying belt which may be used to make the cellulosic fibrous structure according to FIGS. 1 and 2.

As illustrated in FIG. 4, particularly the drying belt 50 according to the present invention is modified from the prior art to provide regions 24, 26 and 28 in the cellulosic fibrous structure 20 according to the present invention having aesthetically distinguishable optically intensive properties. One way to provide regions 24, 26 and 28 in the cellulosic fibrous structure 20 having a visually distinguishable value of an optically intensive property is to provide a drying belt 50 having a background array 52 of flow elements and a pattern of flow elements arranged in zones 54, 56 and 58 respectively corresponding to the desired background matrix 22 and pattern of regions 24, 26 and 28 in the cellulosic fibrous structure 20.

Figure 6:
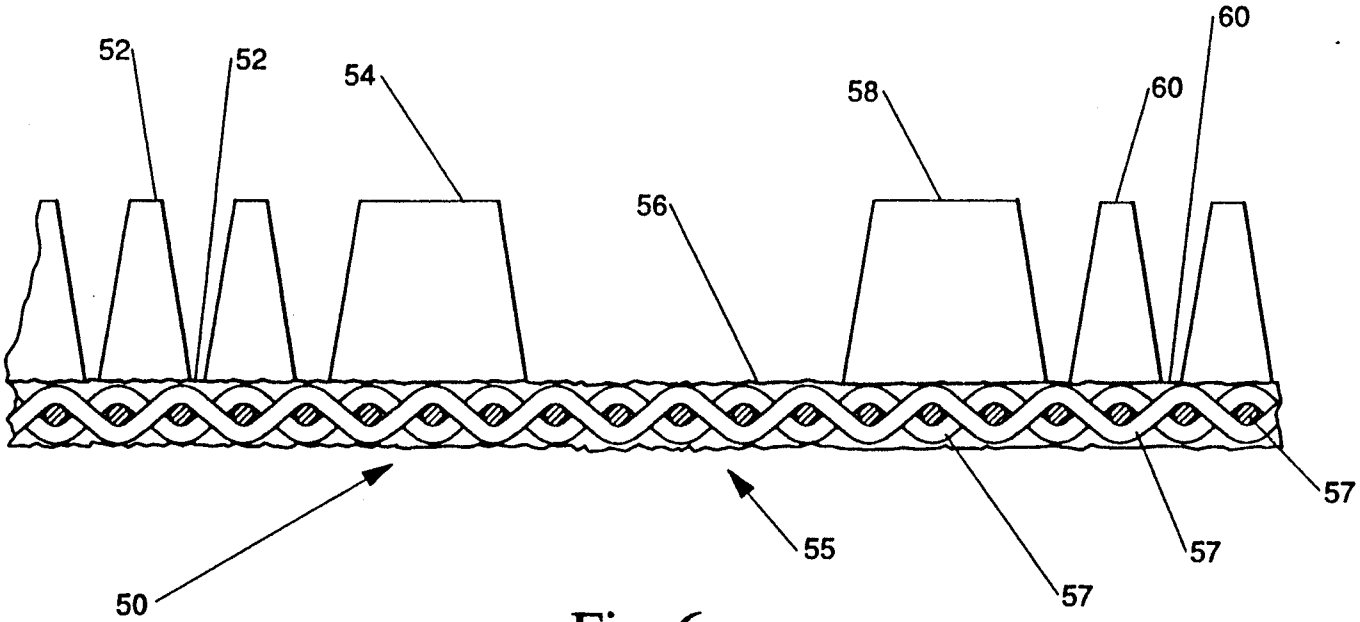
FIG. 6 is a fragmentary vertical sectional view of the drying belt of FIG. 5, taken along line 6—6 of FIG. 5.

Alternatively, differences in elevation between adjacent regions 24, 26 and 28 of the cellulosic fibrous structure 20 may be imparted to the cellulosic fibrous structure 20 by like differences in elevation between the distal ends of adjacent flow elements. As illustrated in FIG. 6, the distal end of the flow element is the free end of a flow element and that end of the flow element which is furthest from the reinforcing structure of the drying belt 50 to which the flow element is attached.

For the drying belts 50 described herein, the knuckles should have a Z dimension perpendicular to the XY plane of the drying belt 50 of at least about 0.08 millimeters (0.003 inches), preferably about 0.13 to about 0.30 millimeters (0.005 to 0.012 inches), but not more than about 0.51 millimeters (0.020 inches), so that the distal end of the knuckle is spaced away from the reinforcing element a distance sufficient to cause differences in elevations between adjacent regions 24, 26 and 28 of the cellulosic fibrous structure 20. Of course, it is to be recognized that the elevation of a deflection conduit is generally coincident the plane of the reinforcing structure.

The background array 52 and adjacent zones 54, 56 and 58 of the drying belt 50 have mutually different flow resistances. The background array 52 and different zones 54, 56 and 58 of the drying belt 50 while, distinguished by flow resistance, may be understood to be distinguished by a related property, the hydraulic radius of the background array 52 or the flow element of the zone.

The flow resistance of the entire drying belt 50 can be easily measured according to techniques well-known to one skilled in the art. However, measuring the flow resistance of selected zones 54, 56 and 58 or the background array 52 and measuring the differences in flow resistance therebetween is more difficult. This difficulty arises due to the small size of the zones 54, 56 and 58.

Fortunately, the flow resistance of a zone or of the background array 52 may be inferred from the hydraulic radius of the background array 52 or of the zone under consideration. The hydraulic radius of a zone is defined as the flow area of the zone divided by the wetted perimeter of the zone. The denominator frequently includes a constant, such as 4. However, since, for this purpose, it is only important to examine differences between the hydraulic radii of the zones 54, 56 and 58, the constant may either be included or omitted as desired. Algebraically this may be expressed as:

$$\text{Hydraulic Radius} = \frac{\text{Flow Area}}{k \times \text{Wetted Perimeter}}$$

wherein the flow area is the area through the zone 54, 56 or 58 or of a unit area of the background array 52 and the wetted perimeter is the linear dimension of the perimeter of the zone 54, 56 or 58 or of a unit area of the background array 52 in contact with the liquid.

The hydraulic radii of several common shapes is well-known and can be found in many references such as Mark's Standard Handbook for Mechanical Engineers, eight edition, which reference is incorporated herein by reference for the purpose of showing the hydraulic radius of several common shapes and a teaching of how to find the hydraulic radius of irregular shapes.

The different zones 54, 56 and 58 of the drying belt 50 may be formed by flow elements. The flow elements, without regard to their hydraulic radius, are distinguished from one another by the flow resistance. At one end of the spectrum is a flow element, hereinafter referred to as a "knuckle," having infinite flow resistance and being remote in position from the XY plane of the drying belt 50. At the opposite end of the spectrum is a flow element having almost no flow resistance (beyond that contributed by the reinforcing structure) and hereinafter referred to as a "deflection conduit."

The flow element of the background array 52 of the drying belt 50 may be comprised of a plurality of zones which are aggregated to form a continuous pattern in the field of the drying belt 50. Adjacent flow elements in the drying belt 50 provide for the different zones 54, 56 and 58 of the drying belt 50 which produce the aforementioned different values of optically intensive properties of the regions 24, 26 and 28 of the cellulosic fibrous structure 20.

The pattern of the zones 54, 56 and 58 may comprise a series of knuckles and deflection conduits which correspond in size, shape, disposition, orientation etc. to the like pattern formed by the aforementioned regions 24, 26 and 28 in the cellulosic fibrous structure 20. The difference in hydraulic radii and elevation, and hence flow resistance, between adjacent flow elements will result in differences in the values of optically intensive properties to occur in the different regions 24, 26 and 28 of the cellulosic fibrous structure 20 manufactured by such a belt. Thus, almost any desired pattern in a cellulosic fibrous structure 20 can be accomplished, by providing the desired pattern in the drying belt 50 of the papermaking apparatus.

Figure 5:
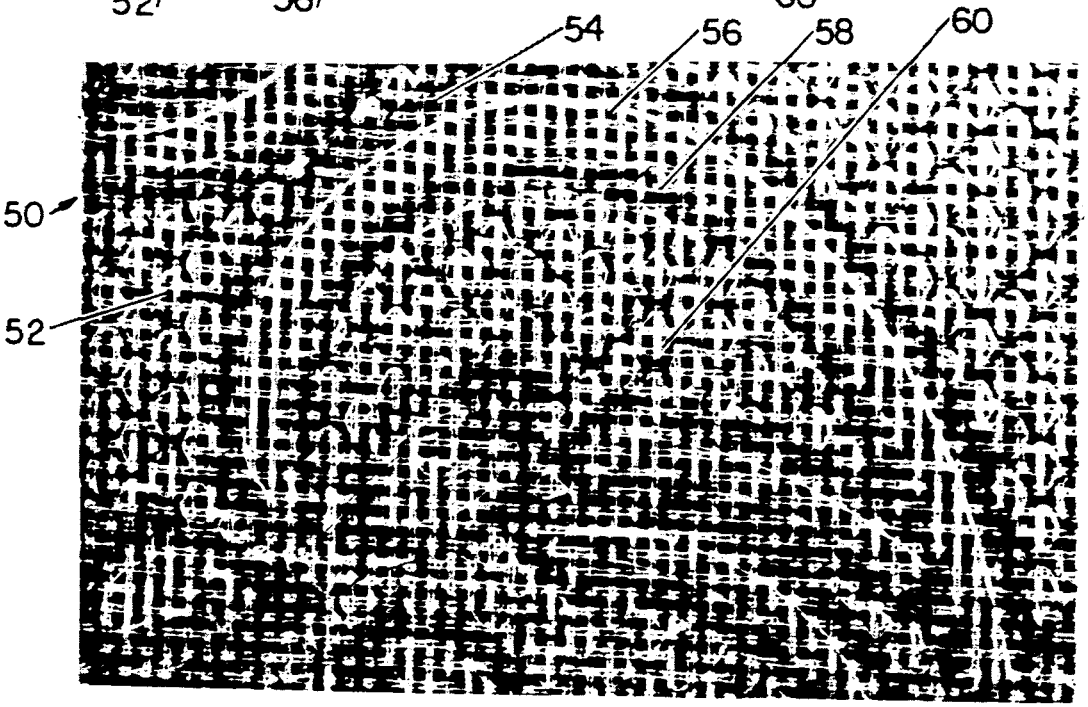
FIG. 5 is a fragmentary top plan view of a drying belt which may be used to make the cellulosic fibrous structure according to FIGS. 1 and 3.

For example, as illustrated in FIG. 4, the pattern of zones 54, 56 and 58 may comprise an annular first zone 54 formed by a flow element. The first zone 54 circumscribes an annular second zone 56, having a flow resistance different than that of the first zone 54. The second zone 56 circumscribes an annular third zone 58 having a flow resistance different than that of the second zone 56. Referring to FIG. 5 and as described above relative to FIG. 3, the third zone 58 may also be annular and circumscribe a fourth zone 60 having a flow resistance different than that of the third zone 58.

The zones 54, 56, 58 and 60 may be arranged in any desired pattern, which will of course correspond to the visually discernible pattern in the cellulosic fibrous structure 20 after drying. The zones 54, 56 or 58 may comprise any alternating series of knuckles and pillows, so long as the first zone 54 is different in the value of the optically intensive property than the background array 52.

It is preferred that the alternating series of flow elements have a knuckle for the first zone 54, so that a relatively sharp demarkation is apparent between the first zone 54 and the background array 52. Conversely the second zone 56 should comprise a deflection conduit, so that it is different in flow resistance than the first zone 54. The third zone 58 should then comprise a knuckle to be different than the second zone 56. If the drying belt 50 does not have four zones 54, 56, 58, and 60, the third zone 58 may comprise a flow element similar to the background array 52. This pattern of knuckle-pillow-knuckle from the first to the third zones 54 to 56 produces a like pattern of relatively denser, relatively less dense and relatively denser regions 24 to 28 in the cellulosic fibrous structure 20.

If the alternating series of flow elements has a deflection conduit comprising the first zone 54, a cellulosic fibrous structure 20 having a somewhat serrated appearance between the background matrix 22 and the first region 24 may result and the usable life of the drying belt 50 may be diminished. Thus, maximum visually distinguishability between regions 24, 26 and 28 of the cellulosic fibrous structure occurs when the difference in flow resistance between adjacent zones 54, 56 and 58 is maximized.

ANALYTICAL PROCEDURES

Opacity

To directly quantify relative differences in opacity, a Nikon stereomicroscope, model SMZ-2T sold by the Nikon Company, of New York, N.Y. may be used in conjunction with a C-mounted Dage MTI of Michigan City, Ind. model NC-70 video camera. The image from the microscope may be stereoscopically viewed through the oculars or viewed in two dimensions on a computer monitor. The analog image data from the camera attached to the microscope may be digitized by a video card made by Data Translation of Marlboro, Mass. and analyzed on a Macintosh IIx computer made by the Apple Computer Co. of Cupertino, Calif. Suitable software for the digitization and analysis is IMAGE, version 1.31, available from the National Institute of Health, in Washington, D.C.

By using the mean density options of the IMAGE software to measure the opacity, relative differences in opacity can be easily obtained due to the attenuation of light passing through various regions 24, 26 and 28 of the sample. The mean density option gives the grey level value of a particular region 24, 26 or 28 under consideration as the mean pixel grey level value of that region 24, 26 or 28. The pixels have a grey level range from 0 (pure black) to 255 (pure white).

Without the sample on the microscope stage, the room lights are darkened and the microscope source light intensity adjusted to make the grey levels of the regions fall within the range of 0 to 255. The lighting is optimized to make the background distribution of grey levels both narrow and as close to zero as possible. The sample is placed on the microscope stage at approximately 10× magnification. To account for variations in the background lighting, it is substracted from each of the actual sample images. After this background substraction, the region 24, 26 or 28 of interest is then defined using the mouse and the mean grey level value read directly from the monitor.

Figure 7:
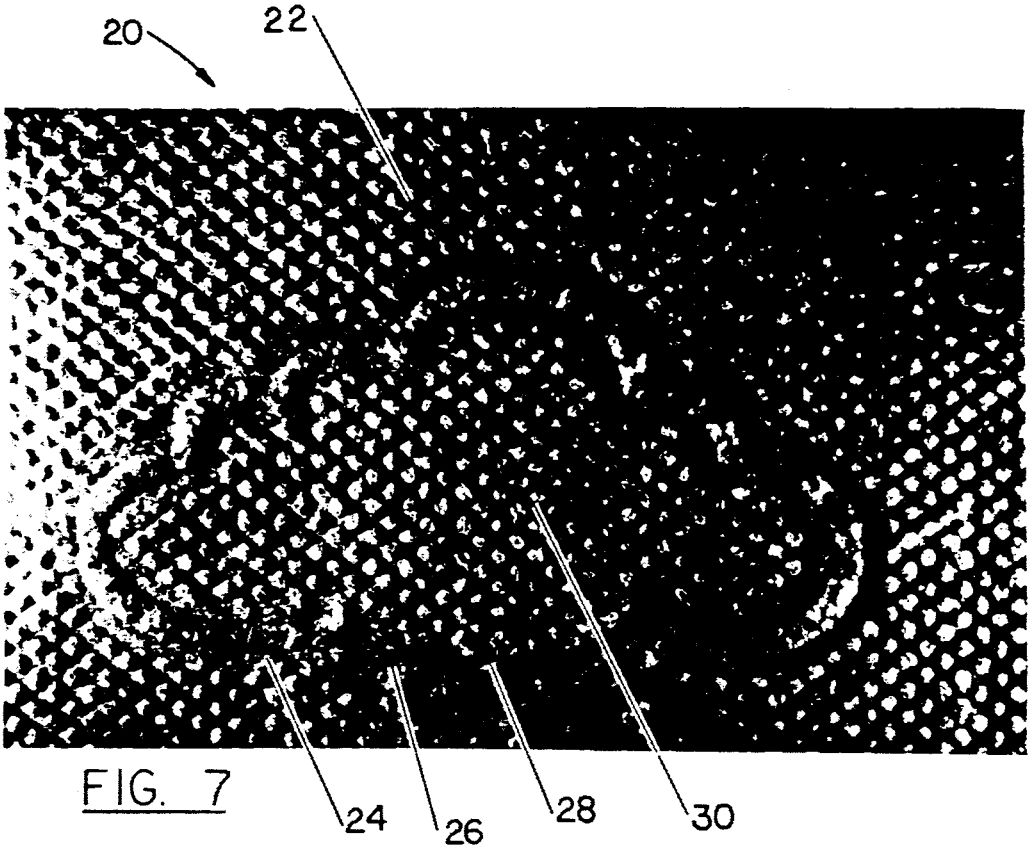
FIG. 7 is a top plan view of an alternative embodiment of a four region fibrous structure according to the present invention.

If desired, absolute opacity of the various regions may be determined by calibrating IMAGE with optical density standards. For example, the mean grey level values of various regions 24, 26 and 28 of FIG. 7 are specified below.

Basis Weight

The basis weight of a cellulosic fibrous structure 20 according to the present invention may be qualitatively measured by optically viewing (under magnification if desired) the fibrous structure 20 in a direction generally normal to the plane of the fibrous structure 20. If differences in the amount of fibers, particularly the amount observed from any line normal to the plane, occur in a nonrandom, regular repeating pattern, it can generally be determined that basis weight differences occur in a like fashion.

Particularly the judgment as to the amount of fibers stacked on top of other fibers is relevant in determining the basis weight of any particular region 24, 26 or 28 or differences in basis weights between any two regions 24, 26 or 28. Generally, differences in basis weights among the various regions 24, 26 or 28 will be indicated by inversely proportional differences in the amount of light transmitted through such regions 24, 26 or 28.

If a more accurate determination of the basis weight of one region 24, 26 or 28 relative to a different region 24, 26, or 28, is desired, such magnitude of relative distinctions may be quantified using multiple exposure soft X-rays to make a radiographic image of the sample, and subsequent image analysis. Using the soft X-ray and image analysis techniques, a set of standards having known basis weights are compared to a sample of the fibrous structure 20. The analysis uses three masks: one to show each of the regions 24, 26 or 28. Reference will be made to memory channels 2–7 in the following description. However, it is to be understood while memory channels 2–7 relate to a specific example, the following description of basis weight determination is not so limited.

In the comparison, the standards and the sample are simultaneously soft X-rayed in order to ascertain and calibrate the gray level image of the sample. The soft X-ray is taken of the sample and the intensity of the image is recorded on the film in proportion to the amount of mass, representative of the fibers in the fibrous structure 20, in the path of the X-rays.

If desired, the soft X-ray may be carried out using a Hewlett Packard Faxitron X-ray unit supplied by the Hewlett Packard Company, of Palo Alto, Calif. X-ray film sold as NDT 35 by the E.I. DuPont Nemours & Co. of Wilmington, Del. and JOBO film processor rotary tube units may be used to advantageously develop the image of the sample described hereinbelow.

Due to expected and ordinary variations between different X-ray units, the operator must set the optimum exposure conditions for each X-ray unit. As used herein, the Faxitron unit has an X-ray source size of about 0.5 millimeters, a 0.64 millimeters thick Beryllium window and a three milliamp continuous current. The film to source distance is about 61 centimeters and the voltage about 8 kVp. The only variable parameter is the exposure time, which is adjusted so that the digitized image would yield a maximum contrast when histogrammed as described below.

The sample is die cut to dimensions of about 2.5 by about 7.5 centimeters (1 by 3 inches). If desired, the sample may be marked with indicia to allow precise determination of the locations of regions 24, 26 and 28 having distinguishable basis weights. Suitable indicia may be incorporated into the sample by die cutting three holes out of the sample with a small punch. For the embodiments described herein, a punch about 1.0 millimeters (0.039 inches) in diameter has been found to work well. The holes may be colinear or arranged in a triangular pattern.

These indicia may be utilized, as described below, to match regions 24, 26 and 28 of a particular basis weight with regions 24, 26 and 28 distinguished by other intensive properties, such as thickness and/or density. After the indicia are placed on the sample, it is weighed on an analytical balance, accurate to four significant figures.

The DuPont NDT 35 film is placed onto the Faxitron X-ray unit, emulsion side facing upwards, and the cut sample is placed onto the film. About five 15 millimeter×15 millimeter calibration standards of known basis weights (which approximate and bound the basis weight of the various regions 24, 26, and 28 of the sample) and known areas are also placed onto the X-ray unit at the same time, so that an accurate basis weight to gray level calibration can be obtained each time the image of the sample is exposed and developed. Helium is introduced into the Faxitron for about 5 minutes at a regulator setting of about one psi, so that the air is purged and, consequently, absorption of X-rays by the air is minimized. The exposure time of the unit is set for about 2 minutes.

Following the helium purging of the sample chamber, the sample is exposed to the soft X-rays. When exposure is completed, the film is transferred to a safe box for developing under the standard conditions recommended by E.I. DuPont Nemours & Co., to form a completed radiographic image.

The preceding steps are repeated for exposure time periods of about 2.2, 2.5, 3.0, 3.5 and 4.0 minutes. The film image made by each exposure time is then digitized by using a high resolution radioscope Line Scanner, made by Vision Ten of Torrence, Calif., in the 8 bit mode. Images may be digitized at a spatial resolution of 1024×1024 discrete points representing 8.9×8.9 centimeters of the radiograph. Suitable software for this purpose includes Radiographic Imaging Transmission and Archive (RITA) made by Vision Ten. The images are then histogrammed to record the frequency of occurrence of each gray level value. The standard deviation is recorded for each exposure time.

The exposure time yielding the maximum standard deviation is used throughout the following steps. If the exposure times do not yield a maximum standard deviation, the range of exposure times should be expanded beyond that illustrated above. The standard deviations associated with the images of expanded exposure times should be recalculated. These steps are repeated until a clearly maximum standard deviation becomes apparent. The maximum standard deviation is utilized to maximize the contrast obtained by the scatter in the data. For the samples illustrated in memory channels 2–7, an exposure time of about 2.5 to about 3.0 minutes was judged optimum, The optimum radiograph is re-digitized in the 12 bit mode, using the high resolution Line Scanner to display the image on a 1024—1024 monitor at a one to one aspect ratio and the Radiographic Imaging Transmission and Archive software by Vision Ten to store, measure and display the images. The scanner lens is set to a field of view of about 8.9 centimeters per 1024 pixels. The film is now scanned in the 12 bit mode, averaging both linear and high to low lookup tables to convert the image back to the eight bit mode.

This image is displayed on the 1024×1024 line monitor. The gray level values are examined to determine any gradients across the exposed areas of the radiograph not blocked by the sample or the calibration standards. The radiograph is judged to be acceptable if any one of the following three criteria is met:

- the film background contains no gradients in gray level values from side to side;
- the film background contains no gradients in gray level values from top to bottom; or
- a gradient is present in only one direction, i.e. a difference in gray values from one side to the other side at the top of the radiograph is matched by the same difference in gradient at the bottom of the radiograph.

One possible shortcut method to determine whether or not the third condition may be met is to examine the gray level values of the pixels located at the four corners of the radiograph, which covers are adjacent the sample image.

The remaining steps may be performed on a Gould Model IP9545 Image Processor, made by Gould, Inc., of Fremont, Calif. and hosted by a Digitized Equipment Corporation VAX 8350 computer, using Library of Image Processor Software (LIPS) software.

A portion of the film background representative of the criteria set forth above is selected by utilizing an algorithm to select areas of the sample which are of interest. These areas are enlarged to a size of 1024×1024 pixels to simulate the film background. A gaussian filter (matrix size 29×29) is applied to smooth the resulting image. This image, defined as not containing either the sample or standards, is then saved as the film background.

This film background is digitally subtracted from the subimage containing the sample image on the film background to yield a new image. The algorithm for the digital subtraction dictates that gray level values between 0 and 128 should be set to a value of zero, and gray level values between 129 and 255 should be remapped from 1 to 127 (using the formula x-128). Remapping corrects for negative results that occur in the subtracted image. The values for the maximum, minimum, standard deviation, median, mean, and pixel area of each image area are recorded.

The new image, containing only the sample and the standards, is saved for future reference. The algorithm is then used to selectively set individually defined image areas for each of the image areas containing the sample standards. For each standard, the gray level histogram is measured. These individually defined areas are then histogrammed.

The histogram data from the preceding step is then utilized to develop a regression equation describing the mass to gray level relationship and which computes the coefficients for the mass per gray value equation. The independent variable is the mean gray level. The dependent variable is the mass per pixel in each calibration standard. Since a gray level value of zero is defined to have zero mass, the regression equation is forced to have a y intercept of zero. The equation may utilize any common spreadsheet program and be run on a common desktop personal computer.

The algorithm is then used to define the area of the image containing only the sample. This image, stored in memory address 2, is saved for further reference, and is also classified as to the number of occurrences of each gray level. The regression equation is then used in conjunction with the classified image data to determine the total calculated mass. The form of the regression equation is:

$$Y=A\times X\times N$$

wherein Y equals the mass for each gray level bin; A equals the coefficient from the regression analysis; X equals the gray level (range 0–255); and N equals the number of pixels in each bin (determined from classified image). The summation of all of the Y values yields the total calculated mass. For precision, this value is then compared to the actual sample mass, determined by weighing.

The calibrated image of memory address 2 is displayed onto the monitor and the algorithm is utilized to analyze a 256×256 pixel area of the image. This area is then magnified equally in each direction six times. All of the following images are formed from this resultant image.

If desired, an area of the resultant image, stored in memory address 7, containing about ten nonrandom, repeating patterns of the various regions 24, 26, and 28 may be selected for segmentation of the various regions 24, 26 or 28. The resultant image in memory address 7 is saved for future reference. Using a digitizing tablet equipped with a light pen, an interactive graphics masking routine may be used to define transition regions between the high basis weight regions 24, 26 or 28 and the low basis weight regions 24, 26 or 28 . The operator should subjectively and manually circumscribe the discrete regions 24, 26 or 28 with the light pen at the midpoint between the discrete regions 24, 26 or 28 and the continuous regions 24, 26 and 28 and fill in these regions 24, 26 or 28. The operator should ensure a closed loop is formed about each circumscribed discrete region 24, 26 or 28. This step creates a border around and between any discrete regions 26 which can be differentiated according to the gray level intensity variations.

The graphics mask generated in the preceding step is then copied through a bit plane to set all masked values to a value of zero, and all unmasked values to a value of 128. This mask is saved for future reference. This mask, covering the discrete regions 24, 26, or 28 is then outwardly dilated four pixels around the circumference of each masked region 24, 26 or 28.

The aforementioned magnified image of memory address 7 is then copied through the dilated mask. This produces an image stored in memory address 5, having only the continuous network of eroded high basis weight regions 24, 26 or 28. The image of memory address 5 is saved for future reference and classified as to the number of occurrences of each gray level value.

The original mask is copied through a lookup table that reramps gray values from 0–128 to 128–0. This reramping has the effect of inverting the mask. This mask is then inwardly dilated four pixels around the border drawn by the operator. This has the effect of eroding the discrete regions 24, 26 or 28.

The magnified image of memory address 7 is copied through the second dilated mask, to yield the eroded low basis weight regions 24, 26 or 28. The resulting image, stored in memory address 3, is then saved for future reference and classified as to the number of occurrences of each gray level.

In order to obtain the pixel values of the transition regions, the two four pixel wide regions dilated into both the high and low basis weight regions 24, 26, and 28, one should combine the two eroded images made from the dilated masks as shown in memory addresses 4 and 6. This is accomplished by first loading one of the eroded images into one memory channel and the other eroded image into another memory channel.

The image of memory address 3 is copied onto the image of memory address 5, using the image of memory address 3 as a mask. Because the second image of memory address 5 was used as the mask channel, only the non-zero pixels will be copied onto the image of memory address 5. This procedure produces an image containing the eroded high basis weight regions 24, 26 and 28, the eroded low basis weight regions 26, but not the nine pixel wide transition regions (four pixels from each dilation and one from the operator's circumscription of the regions 24, 26 or 28). This image, stored in memory address 6, without the transition regions is saved for future reference.

Since the pixel values for the transition regions 33 in the transition region image of memory address 6 all have a value of zero and one knows the image cannot contain a gray level value greater than 127, (from the subtraction algorithm), all zero values are set to a value of 255. All of the non-zero values from the eroded high and low basis weight regions 24, 26, and 28 in the image of memory address 6 are set to a value of zero. This produces an image which is saved for future reference.

To obtain the gray level values of the transition regions, the image of memory address 7 is copied through the image of memory address 6 to obtain only the nine pixel wide transition regions. This image, stored in memory address 4, is saved for future reference and also classified as to the number of occurrences per grey level.

So that relative differences in basis weight for the low basis weight regions 26, high basis weight regions 24, 26 or 28, and transition region can be measured, the data from each of the classified images above, and in memory addresses 4, 6 and 5 respectively are then employed with the regression equation derived from the sample standards. The total mass of any region 24, 26 or 28 is determined by the summation of mass per grey level bin from the image histogram. The basis weight is calculated by dividing the mass values by the pixel area, considering any magnification.

The classified image data (frequency) for each region 24, 26 or 28 of the images in memory addresses 4–6 and 8 may be displayed as a histogram and plotted against the mass (gray level), with the ordinate as the frequency distribution. If the resulting curve is further indication that a nonrandom, repeating pattern of basis weights is present in the sample of the cellulosic fibrous structure 20.

If desired, basis weight differences may be determined by using an electron beam source, in place of the aforementioned soft X-ray. If it is desired to use an electron beam for the basis weight imaging and determination, a suitable procedure is set forth in European Patent Application 0,393,305 A2 published Oct. 24, 1990 in the names of Luner et al., which application is incorporated herein by reference for the purpose of showing a suitable method of determining differences in basis weights of various regions 24, 26 and 28 of the cellulosic fibrous structure 20.

Crepe Frequency

The crepe frequency of the cellulosic fibrous structure 20 may be measured utilizing the aforementioned Nikon stereomicroscope, the Dage camera and the IMAGE data analysis software, in conjunction with a Data Translation of Marlboro, Mass. Model DT2255 frame grabber card. The system is calibrated using a ten millimeter optical micrometer and a ruler tool and by drawing a line between two points separated by a known distance. The scale is then sent to this distance. After calibrating, the magnification of the microscope should not be changed throughout the following steps. For the embodiments described herein, a magnification of about 60× to about 70× has been found suitable.

A sample of the cellulosic fibrous structure 20 to be examined is placed on the stage of the microscope and focused without changing magnification. Using the ruler tool of the IMAGE program, the distance between two points of interest, such as peaks or valleys in the crepe, or between adjacent regions 24, 26 or 28 or between regions of interest in the background matrix 22 are measured. The reciprocal of this measurement is recorded as a crepe frequency datum point and the measurement repeated sufficient times to assure statistically significant data are obtained.

Elevation

A preferred method to determine the elevation of different regions 24, 26 and 28 of the cellulosic fibrous structure 20 is to topographically measure the elevation of either exposed face of the cellulosic fibrous structure 20. This measurement produces a pattern of isobaths on one face of the fibrous structure 20 and a pattern of isobases on the other face.

The value of like isopleths above or below the reference plane from which the measurements are made yields the elevation of the various regions 24, 26 and 28 of the sample being measured. Similarly the presence of like isopleths in a given linear distance yields the crepe frequency of the regions 24, 26 and 28 of the sample being measured.

The topographical measurements may be made using a Federal Products Series 432 profilometer having a Model EAS-2351 amplifier, a Model EPT-01049 breakaway probe, stylus and a flat horizontal table, sold by the Federal Esterline Company of Providence, R.I. For the measurements described herein, the stylus had a 2.54 micron (0.0001 inch) radius and a vertical force loading of 200 milligrams. The table is planar to 0.2 microns.

A sample of the fibrous structure 20 to be measured is placed on the horizontal table and any noticeable wrinkles are smoothed. The sample may be held in place with magnetic strips. The sample is scanned in a square wave pattern at a rate of 60.0 millimeters per minute (2.362 inches per minute) or 1.0 millimeter per second. The data digitization rate converts 20 data points per millimeter, so that a reading is taken every 50 microns.

The sample is traced 30 millimeters in one direction, then manually indexed while in motion 0.1 millimeters (0.004 inches) in a traverse direction. This process is repeated until the desired area of the sample has been scanned. Preferably the trace starts at one of the punched holes, so that registering the isograms of opposite faces, as described below, is more easily accomplished.

If desired, the digitized data may be fed into and analyzed by any Fourier transform analysis package. An analysis package such as Proc Spectra made by SAS of Princeton, N.J. has been found to work well. The Fourier analysis of each face of the fibrous structure 20, quantifies the crepe frequency of the nonrandom patterns on that surface. It will be apparent that the pitch and spacing of the different regions 24, 26 and 28 in the cellulosic fibrous structure 20 will appear in the Fourier transform as yet a different (lesser) frequency than the crepe frequency within the region 24, 26 or 28 under consideration.

Similarly, many common analysis packages plot the aforementioned isobathic and isobasic data in multicolor isograms. By properly selecting the threshold of these isograms to correspond in elevation to the background matrix of the cellulosic fibrous structure 20, the isograms can be used to determine the elevations of different regions 24, 26 and 28 relative to each other or relative to the background matrix 22.

If it is not desired to use a stereoscan microscope, the determination of the thickness of various regions 24, 26 and 28 of the sample may be made by confocal laser scanning microscopy. Confocal laser scanning microscopy may be made using any confocal scanning microscope capable of measuring the dimension normal to the plane of the sample. A Phoibos 1000 Model microscope made by Sarastro Inc., of Ypsilanti, Mich., should be suitable for this purpose.

Using the Sarastro Confocal Scanning Microscope, a sample measuring approximately 2 centimeters by approximately 6 centimeters of the fibrous structure 20 is placed on top of a glass microscope slide. The microscope slide is placed under the objective lens and viewed under relatively low magnification (approximately 40×). This magnification enlarges the field of view sufficient that the number of surface features is maximized. When viewing at the sample at lower magnification, one should focus on the uppermost portion of the sample.

Preferably, by utilizing the fine focus adjustment of the microscope and the Z axis reading displayed on the monitor of the microscope, the microscope stage is lowered approximately 100 micrometers. The optical image output of the microscope is transferred from the oculars to the optical bench. This transfer changes the image output from the eyes of the operator to the detector of the microscope.

With the microscope computer, the step size and number of sections is now input. A step size of about 10 to about 40 micrometers and a number of about 20 to about 80 sections should be generally suitable. These parameters result in the acquisition of 20 to 80 optical XY slices at an interval of 10 to 40 micrometers, for a total depth of 800 micrometers normal to the plane of the sample.

Such settings allow optical sections to be acquired from slightly above the top surface of the sample of the fibrous structure 20, to slightly below the bottom surface of the sample of the fibrous structure. It will be apparent to one skilled in the art, that if higher resolution is desired, a smaller step size and a larger number of steps is required.

Using these settings, one begins the scanning process. The computer of the microscope will acquire the desired number of XY slices at the desired interval. The digitized data from each slice is stored in the memory of the microscope.

To obtain the measurements of interest, each slice is viewed on the computer monitor to determine which slice offers the most representative view of the features of interest, particularly the thickness of the sample. While viewing the slice of the sample which best illustrates the different regions 24, 26 and 28 of the sample, a line is drawn through the region 24, 26, or 28 of interest of a sample similar to that illustrated in FIG. 2. The XY function of the microscope is utilized so that a cross sectional view of the line is displayed. This cross sectional view is made up of all of the slices taken of the sample.

To measure the thickness, two Z axis points of interest are entered. For example, to measure the thickness of a region 24, 26, or 28, the two points would be entered, one on each opposed surface of the sample.

If desired, reference microtomes may be made to determine the crepe frequency and elevation of different regions 24, 26 and 28 of the cellulosic fibrous structure 20. To determine the crepe frequency and elevation of different regions 24, 26 and 28 of the cellulosic fibrous structure 20 using reference microtomes, a sample measuring about 2.54 centimeters by 5.1 centimeters (1 inch by 2 inches) is provided and stapled onto a rigid cardboard holder. The cardboard holder is placed in a silicon mold. A mixture of six parts Versamid resin, four parts Epcon 812 resin and 3 parts of 1,1,1-trichloroethane are mixed in a beaker. The resin mixture is place in a low speed vacuum desiccator and the bubbles removed.

The mixture is then poured into the silicon mold with the cardboard sample holder so that the sample is thoroughly wetted and immersed in the mixture. The sample is cured for at least 12 hours and the resin mixture hardened. The sample is removed from the silicon mold and the cardboard holder removed from the sample.

The sample is marked with a reference point to accurately determine where subsequent measurements are taken. Preferably, the same reference point is utilized in both the plan view and various sectional views of the sample of the cellulosic fibrous structure 20.

Any of three types of reference points are suitable. The reference points may be made using either a sharply pointed needle, a thread contrasting in color, texture and/or shape to the fibrous structure, or a resolution guide. If a needle is selected to make the reference point, the reference point may be marked after the resin, used to mount the sample has cured by puncturing a hole in the sample. If a thread is selected for the reference point, the thread may be applied to the sample in a direction having a vector component generally perpendicular to the subsequent microtoming operation. The resolution guide may be generally planar and laid on top of the sample prior to resin curing and/or photographing. A resolution guide having contrasting indicia radiating outwardly and radially expanding is suitable. A #1-T resolution guide made by Stouffer Graphic Arts Equipment Co. of South Bend, Ind. has been found particularly well suited for this purpose.

The sample is placed in a model 860 microtome sold by the American Optical Company of Buffalo, N.Y. and leveled. The edge of the sample is removed from the sample, in slices, by the microtome until a smooth surface appears.

A sufficient number of slices are removed from the sample, so that the various regions 24, 26, and 28 may be accurately reconstructed. For the embodiment described herein, slices having a thickness of about 100 microns per slice are taken from the smooth surface. At least about 10 to 20 slices are required, so that differences in the thickness of the fibrous structure 20 may be ascertained.

Three to four samples made by the microtome are mounted in series on a slide using oil and a cover slip. The slide and the sample are mounted in a light transmission microscope and observed at about 40× magnification. Pictures are taken to reconstruct the profile of this slice until all 10 to 20 slices, in series, are photographed. By observing the individual photographs of the microtome, differences in crepe frequency and elevation of different regions 24, 26 and 28 and the background matrix 22 may be ascertained as a profile of the topography of the fibrous structure is reconstructed.

VARIATIONS

Illustrated in FIG. 7 is an alternative embodiment of a cellulosic fibrous structure 20 according to the present invention and having four regions 24, 26, 28 and 30, superimposed on a background matrix 22. The three outer regions 24, 26, and 28 are annular and circumscribe the central inner region 30. The central inner region 30 matches the background matrix 22 in the value of the crepe frequencies and elevations. Two of the annular regions 24 and 28 are formed by a knuckle in the drying belt 50 and have matched crepe frequencies and elevations.

The first and third annular regions 24 and 28 of the cellulosic fibrous structure 20 of FIG. 7, have a mean grey level value of about 190. The second annular region 26 has a mean grey level value of about 169. The mean grey level value of the entire structure, considering all regions 24, 26, 28, 30 and the background matrix 22 is about 182.

The first and third annular regions were formed on knuckles of the drying belt 50. The darker appearance and higher grey level value of the first and third regions 24 and 28, relative to the second region 26 is likely due to these regions 24 and 28 having fewer pinholes and more uniform fiber distribution.

We claim:

1. A single lamina cellulosic fibrous structure having at least three visually discernible regions, said cellulosic fibrous structure comprising:

a background matrix having a first value of an optically intensive property;

a nonembossed first annular region having a second value of the optically intensive property, said second value being substantially different than said first value of the optically intensive property of said background matrix;

a nonembossed second annular region having a third value of the optically intensive property, said third value being substantially different than said second value of the optically intensive property of said first annular region, said second annular region being disposed substantially within said first annular region; and a nonembossed third region having a value of the optically intensive property substantially different than said third value of the optically intensive property of said second annular region, said third region being disposed substantially within said second annular region.

2. A cellulosic fibrous structure according to claim 1 wherein said second annular region is generally concentric and generally congruent said first annular region.

3. A cellulosic fibrous structure according to claim 1 wherein said value of the optically intensive property of said third region is substantially equivalent said value of the optically intensive property of said first annular region.

4. A cellulosic fibrous structure according to claim 1 wherein said third region is an annular region.

5. A cellulosic fibrous structure according to claim 4 further comprising a fourth region generally interior said third annular region, said fourth region having a value of the optically intensive property substantially different than said value of the optically intensive property of said third annular region.

6. A cellulosic fibrous structure according to claim 5 wherein said value of the optically intensive property of said fourth region is generally equivalent said first value of the optically intensive property of said background matrix.

7. A cellulosic fibrous structure according to claim 1 wherein said value of the optically intensive property of said third region is substantially equivalent said first value of the optically intensive property of said background matrix.

8. A cellulosic fibrous structure according to claim 1 wherein said first annular region has a density greater than said density of said second annular region.

9. A cellulosic fibrous structure according to claim 8 wherein said third region has a density greater than said density of said second annular region.

* * * * *